US006622625B1

(12) United States Patent
Sugiyama

(10) Patent No.: US 6,622,625 B1
(45) Date of Patent: Sep. 23, 2003

(54) MEDIUM DETECTING METHOD AND DEVICE, AND PRINTER

(75) Inventor: Yuichi Sugiyama, Tokyo (JP)

(73) Assignee: Canon Finetech, Inc., Ibaraki (JP)

( * ) Notice: Subject to any disclaimer, the term of this patent is extended or adjusted under 35 U.S.C. 154(b) by 9 days.

(21) Appl. No.: 10/069,226

(22) PCT Filed: Aug. 31, 2000

(86) PCT No.: PCT/JP00/05918

§ 371 (c)(1),
(2), (4) Date: Feb. 21, 2002

(87) PCT Pub. No.: WO01/15908

PCT Pub. Date: Mar. 8, 2001

(30) Foreign Application Priority Data

Aug. 31, 1999 (JP) ..... 11-245913

(51) Int. Cl.[7] ..... B41F 1/54

(52) U.S. Cl. ..... 101/484; 101/248; 101/486; 101/181; 226/2; 226/20; 250/548; 250/559.36

(58) Field of Search ..... 101/211, 248, 101/484, 486, 181, 226; 250/548, 559.36; 226/2, 18, 19, 20, 21

(56) References Cited

U.S. PATENT DOCUMENTS

| | | | | | |
|---|---|---|---|---|---|
| 3,870,936 | A | * | 3/1975 | Cuberley | 101/248 |
| 4,049,213 | A | * | 9/1977 | Hank et al. | 226/19 |
| 4,641,070 | A | * | 2/1987 | Pfizenmaier et al. | 250/548 |
| 4,789,820 | A | * | 12/1988 | Parrent, Jr. et al. | 324/640 |
| 4,848,632 | A | * | 7/1989 | Mack et al. | 226/18 |
| 5,076,163 | A | * | 12/1991 | Sainio | 101/486 |
| 5,107,131 | A | * | 4/1992 | Okada et al. | 250/559.09 |
| 5,126,578 | A | * | 6/1992 | Roch et al. | 250/548 |
| 5,394,223 | A | * | 2/1995 | Hart et al. | 355/212 |
| 5,992,318 | A | * | 11/1999 | DiBello et al. | 101/181 |
| 6,164,201 | A | * | 12/2000 | Burke | 104/228 |
| 6,281,679 | B1 | * | 8/2001 | King et al. | 324/229 |
| 6,435,117 | B2 | * | 8/2002 | Codos et al. | 112/475.08 |

FOREIGN PATENT DOCUMENTS

| | | |
|---|---|---|
| EP | 763784 | 3/1997 |
| EP | 884197 | 12/1998 |
| JP | 7-89157 | 4/1995 |
| JP | 7-172635 | 7/1995 |
| JP | 10-265096 | 10/1998 |

* cited by examiner

*Primary Examiner*—Eugene H. Eickholt
(74) *Attorney, Agent, or Firm*—Dellett and Walters

(57) ABSTRACT

A reference medium is scanned both with a medium sensor (44) capable of detecting a low-transmittance printing medium with high accuracy and with a medium sensor (45) capable of detecting a high-transmittance medium with low accuracy so as to find edge positions Ry0, Ry1 of the reference medium. The difference Diff0 between the edge positions is calculated and stored as a correction value. If it is hard to detect a printing medium by means of the medium sensor (44), the medium sensor (45) is used to detect the medium, and the resulting edge position is corrected using the correction value Diff0. In addition, for any given printing medium, a first driving level of a light source for outputting a predetermined output amount of the sensor (44) and a second driving level of a light source for outputting a predetermined output amount of the sensor (45) are calculated and, based on the difference between the two driving levels, the type of the printing medium is determined. Thus, various types of printing medium can be read with high accuracy.

6 Claims, 11 Drawing Sheets

FIG. 3 (a) MEDIUM SENSOR
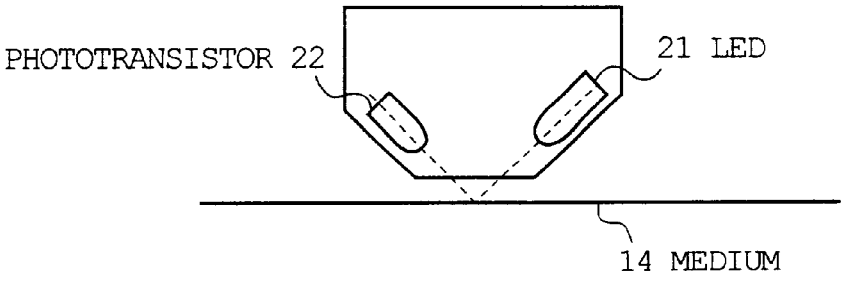
FIG. 3 (b) MEDIUM SENSOR
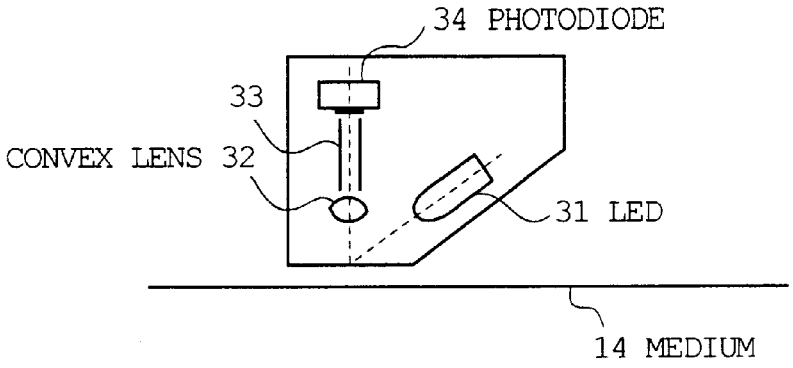
FIG. 4 MEDIUM DETECTION UNIT
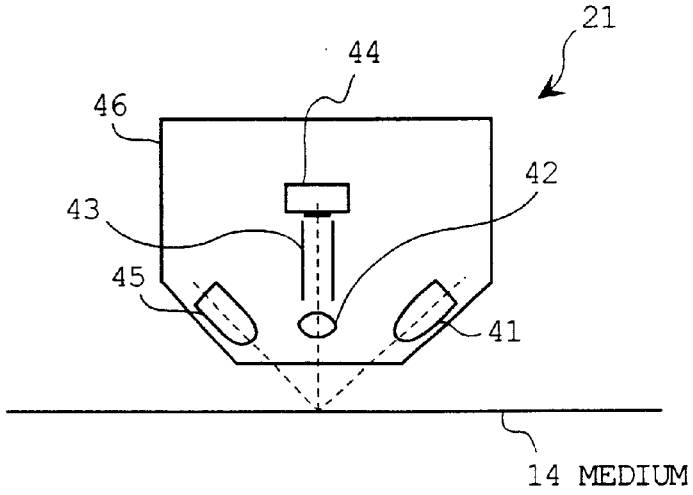

FIG. 6 MEDIUM SENSOR CIRCUIT

FIG. 8 (a)
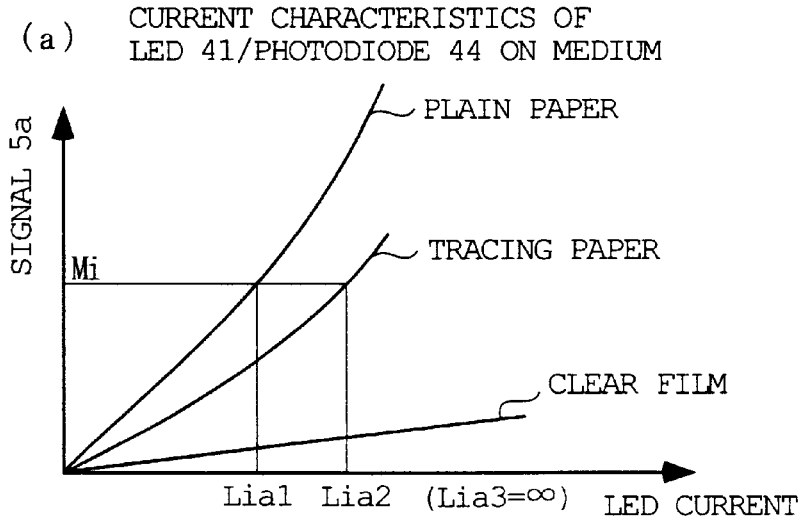
FIG. 8 (b)
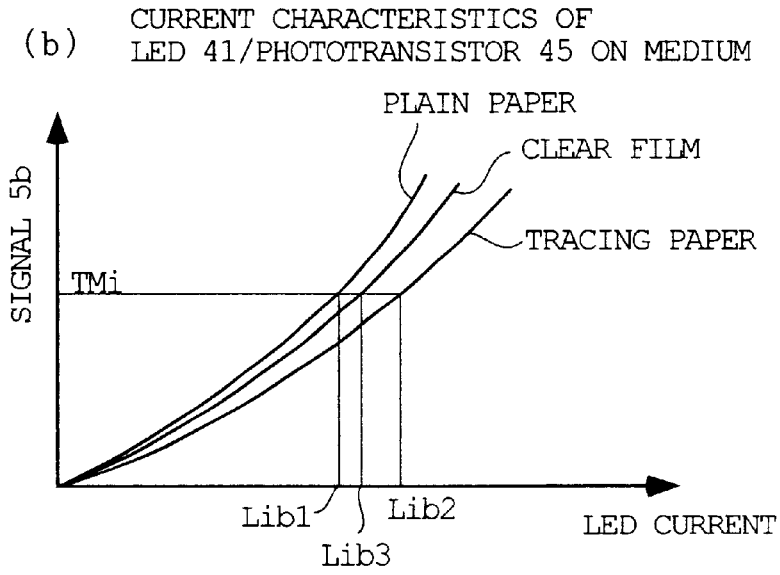
FIG. 8 (c)
$$Di1=|Lib1-Lia1|$$
$$Di2=|Lib2-Lia2|$$
$$Di3=|Lib3-Lia3|$$
$$Di1<Di2<Di3$$

FIG. 9 SENSOR CORRECTION FLOWCHART

FIG. 10 PAPER EDGE DETECTING FLOWCHART

MEDIUM DETECTING METHOD AND DEVICE, AND PRINTER

TECHNICAL FIELD

The present invention relates to the detection of printing media such as a sheet of paper used on a printing device such as a printer or a plotter, and more particularly to the error correction of print positions.

BACKGROUND ART

On a conventional large-format printer or plotter, an operator usually sets a printing medium on the device and, then, a medium sensor provided on a print carriage detects the width of the medium and takes it into the device to detect its leading edge at a predetermined position. In that case, as shown in FIG. 3(*a*), the medium sensor is configured to detect the difference in reflectance between a platen 20 (FIG. 1) and a medium 14. In this configuration, a large sensor spot, 2–3 mm in diameter, is used to detect any medium.

In another configuration, a sensor is provided right above the medium 14 to detect an object directly as shown in FIG. 3(*b*). This configuration allows a light to be detected right above the medium 14, because a diffused light on the medium, which is a light emitted by an LED 31 and diffused on the medium 14, is detected via a lens 32 and a light-shielding cylinder 33. Therefore, this configuration minimizes the effect of the paper condition and allows to reduce the spot diameter down to about 1 mm, thus enabling high-accuracy medium detection.

Although a sensor with the configuration shown in FIG. 3(*a*), which detects a light reflected on the printing medium, detects most media, its large sensor-spot diameter decreases the accuracy of the reading position.

In contrast, although a sensor with the configuration shown in FIG. 3(*b*), which has a small sensor spot, reduces the unevenness in reading positions to 0.5 mm or smaller, it cannot detect a medium, such as a clear film, through which light fully transmits.

Therefore, it is an object of the present invention to provide a medium detecting method and a medium detecting device, as well as a printer, that can read a wider range of printing media with high accuracy.

It is another object of the present invention to provide a printer capable of determining the type of a printing medium.

DISCLOSURE OF THE INVENTION

A medium detecting method according to the present invention is for use in a printer wherein the method detects an edge position of a printing medium while scanning the printing medium, the method comprising the steps of scanning a relatively-low-transmittance reference medium with a first medium sensor and a second medium sensor each to detect an edge position of the reference medium, the first medium sensor being capable of detecting a relatively-low-transmittance printing medium with high accuracy, the second medium sensor being capable of detecting a high-transmittance medium with low accuracy; calculating a difference between the edge positions as a correction value; and if, when detecting any given printing medium, it is difficult for the first medium sensor to detect the printing medium, the second medium sensor is used to detect the medium to correct a resulting edge position with the correction value.

This invention allows a medium (edge position) to be detected with high accuracy regardless of the type of medium.

To implement the method described above, a medium detecting device according to the present invention is for use in a printer wherein the device detects an edge position of a printing medium while scanning the printing medium, the device comprising a first medium sensor capable of detecting a relatively-low-transmittance printing medium with high accuracy; a second medium sensor capable of detecting a high-transmittance medium with low accuracy; means for scanning a relatively-low-transmittance reference medium with the first medium sensor and the second medium sensor each to detect an edge position of the reference medium; means for calculating a difference between the detected edge positions; means for storing the difference as a correction value in a non-volatile manner; and correction means for detecting the medium with the second medium sensor when it is difficult to detect the printing medium with the first medium sensor and for correcting a resulting edge position with the correction value.

Preferably, this medium detecting device further comprises a medium detection unit that contains, in one housing 46, a light source that emits light onto the printing medium obliquely; a first photo-sensor that detects diffused light of the printing medium from right above the printing medium and that acts as the first medium sensor, and a second photo-sensor that accepts a light from the light source reflected upward and obliquely on the printing medium and that acts as the second medium sensor. Installing this medium detection unit on a print carriage eliminates the need for providing separate special scanning means. In addition, the moving position of the medium sensor may be identified with an existing linear scale.

The medium detection device may further comprise medium determination means for calculating, for any given printing medium, a first driving level of the light source for outputting a predetermined sensor output amount of the first photo-sensor and a second driving level of the light source for outputting a predetermined sensor output amount of the second photo-sensor and, based on a difference between the two driving levels, for determining a type of the printing medium.

In addition, based on the determination result, the device may further comprise a printing mode setting means for setting a print mode according to the type of the determined printing medium.

BRIEF DESCRIPTION OF THE DRAWINGS

FIGS. 3(*a*) and 3(*b*) are diagrams showing the configuration of a conventional medium sensor;

FIG. 4 is a diagram showing the configuration of a medium detection unit used in an embodiment of the present invention;

FIGS. 8(*a*) through 8(*c*) are diagrams showing the principle of automatic medium type determination used in an application of the present invention;

BEST MODE FOR CARRYING OUT THE INVENTION

A preferred embodiment of a medium detecting device according to the present invention will be described in detail below.

Figure 1:
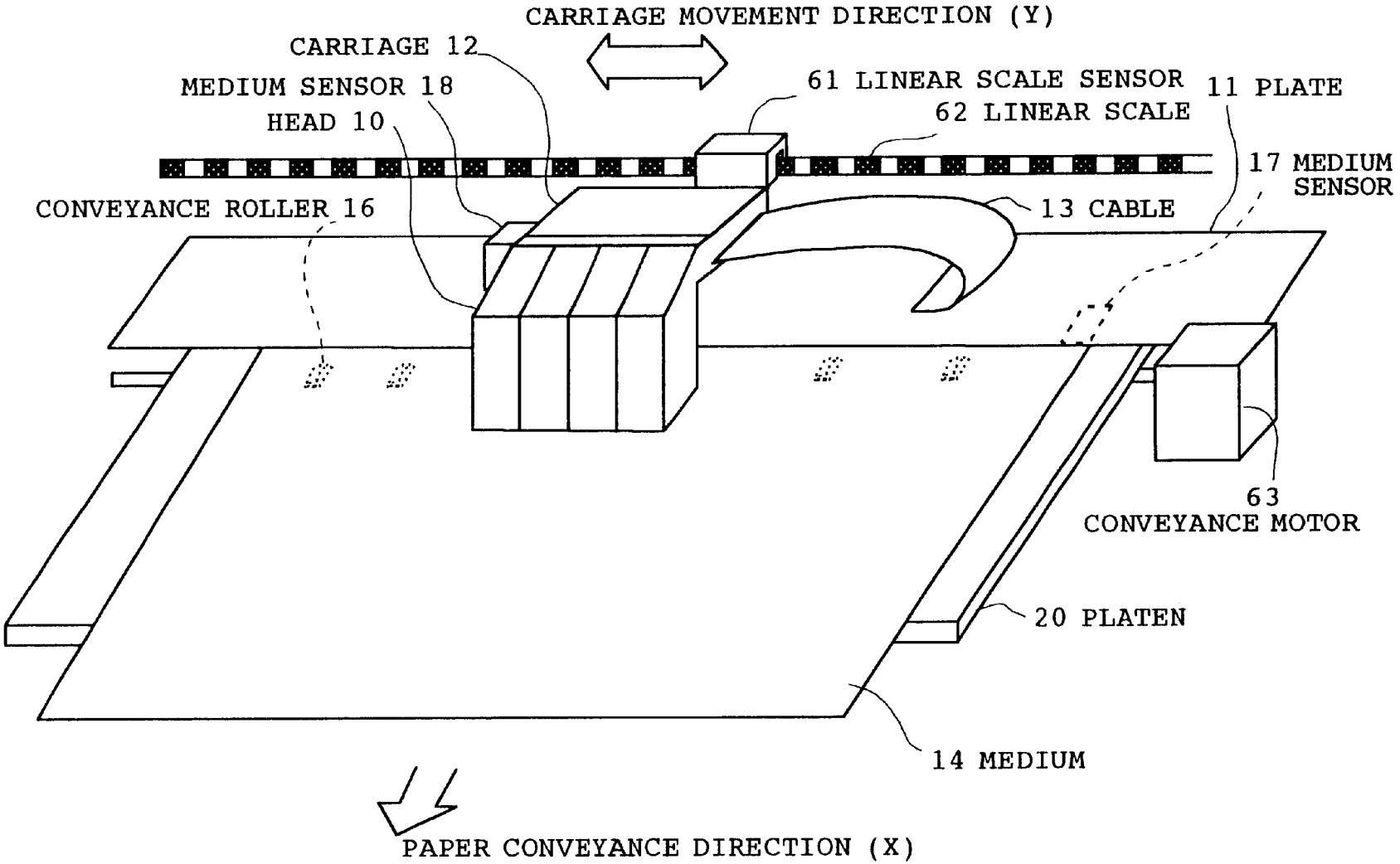
FIG. 1 is a schematic external view of a printing unit of an ink-jet, large-format printer according to the present invention.

FIG. 1 shows a schematic external view of a printing unit of an ink-jet, large format printer according to the present invention. It should be noted that the present invention is not limited to a device using the ink jet recording method.

Referring to FIG. 1, a carriage 12, on which four color heads 10 are mounted, moves back and forth in the carriage movement direction (Y) along a guide rail, driven by an endless wire turned by a carriage motor (none of those shown). A linear scale sensor 61 mounted on the carriage 12 detects the stripe patterns or slits on a linear scale 62 provided at regular intervals along the guide rail to identify the current position of the carriage 12 (and, hence, a medium sensor 18). The position of the carriage 12 may be identified not only by using the linear scale 62 but also by using a rotary encoder or counting the number of driving pulses of the carriage motor. In the figure, numeral 13 indicates a flat cable through which power and various signals are supplied from an engine controller (not shown) to the heads 10. This flat cable 13 is drawn out from inside a plate 11.

Figure 2:
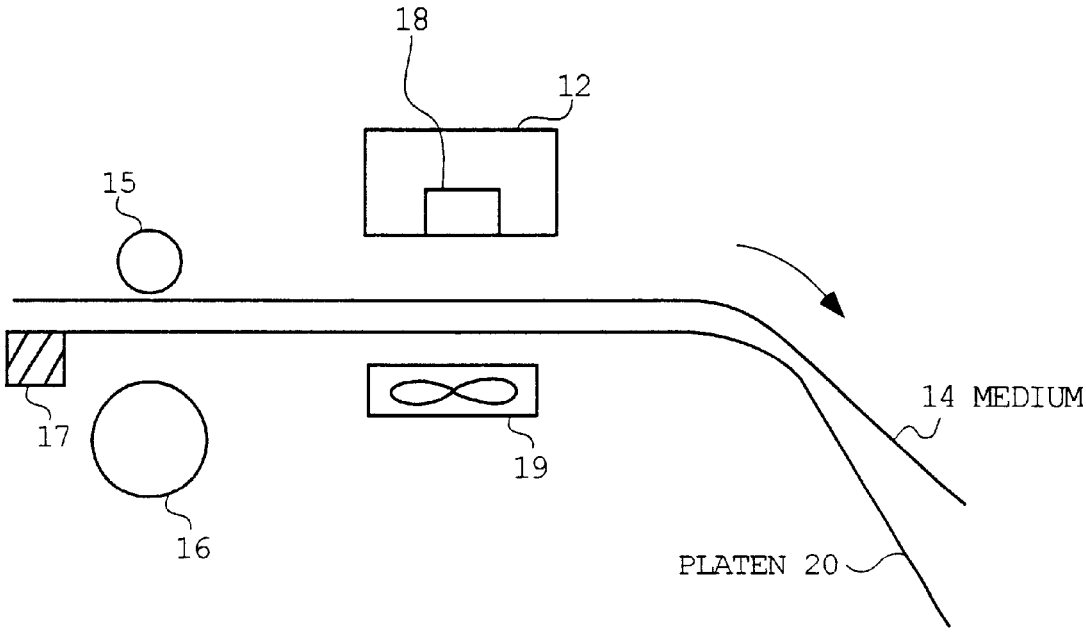
FIG. 2 is a schematic side view of the medium path of the printer shown in FIG. 1.

On the other hand, a medium 14 on which the heads 10 print is driven by a conveyance motor 63 and is conveyed on the platen 20 in the paper conveyance direction (X) almost at right angles to the carriage movement direction via a conveyance roller 16 and a pinch roller 15 (FIG. 2). Below the platen 20 (FIG. 2) is provided a suction fan 19 (FIG. 2) that sucks the medium 14 onto the surface of the platen 20 via air holes (not shown) provided on the platen 20. A medium sensor 17 provided in the conveyance path of the medium 14 detects whether or not the paper is set.

The paper load sequence will be described below. As shown in FIG. 2, the operator releases the pressure of the conveyance roller 16 and the pinch roller 15 and inserts the medium 14 between them. When the medium sensor 17 in the printer body detects that the medium 14 is set, the suction fan 19 starts sucking the medium 14 onto the platen 20. After setting the medium 14, the operator applies pressure on the conveyance roller 16 again to start the load sequence. Next, the printer moves the carriage 12 in the main scanning direction to detect the right and left edges of the medium with the medium sensor 18 on the carriage 12. Next, the printer moves the carriage 12 approximately to the center of the medium and, while conveying the medium backwards (to the left side in FIG. 2), detects the leading edge of the medium with the medium sensor 18. The printer then moves the medium to a predetermined position where printing is to start and enters the standby state. After printing one band, the printer moves the medium 14 one band in the direction perpendicular to the movement direction of the carriage 12. This operation is repeated until one sheet of medium is printed.

Next, FIG. 4 shows the detailed configuration of a medium detection unit 21 that may be used as the medium sensor 18. In the figure, numeral 41 indicates a light emitting diode (LED) that emits light onto the surface of the medium 14 at an angle of about 40 to 45 degrees, numeral 42 indicates a convex lens that directly detects the medium 14, numeral 43 indicates a light shielding cylinder that shields external light and focuses light on a detection object, and numeral 44 indicates a photodiode that detects the medium 14. In addition, numeral 45 is a phototransistor that detects light that is sent from the light emitting diode 41 and that is reflected back from the medium. These parts (41–45) are stored in one housing.

Figure 5:
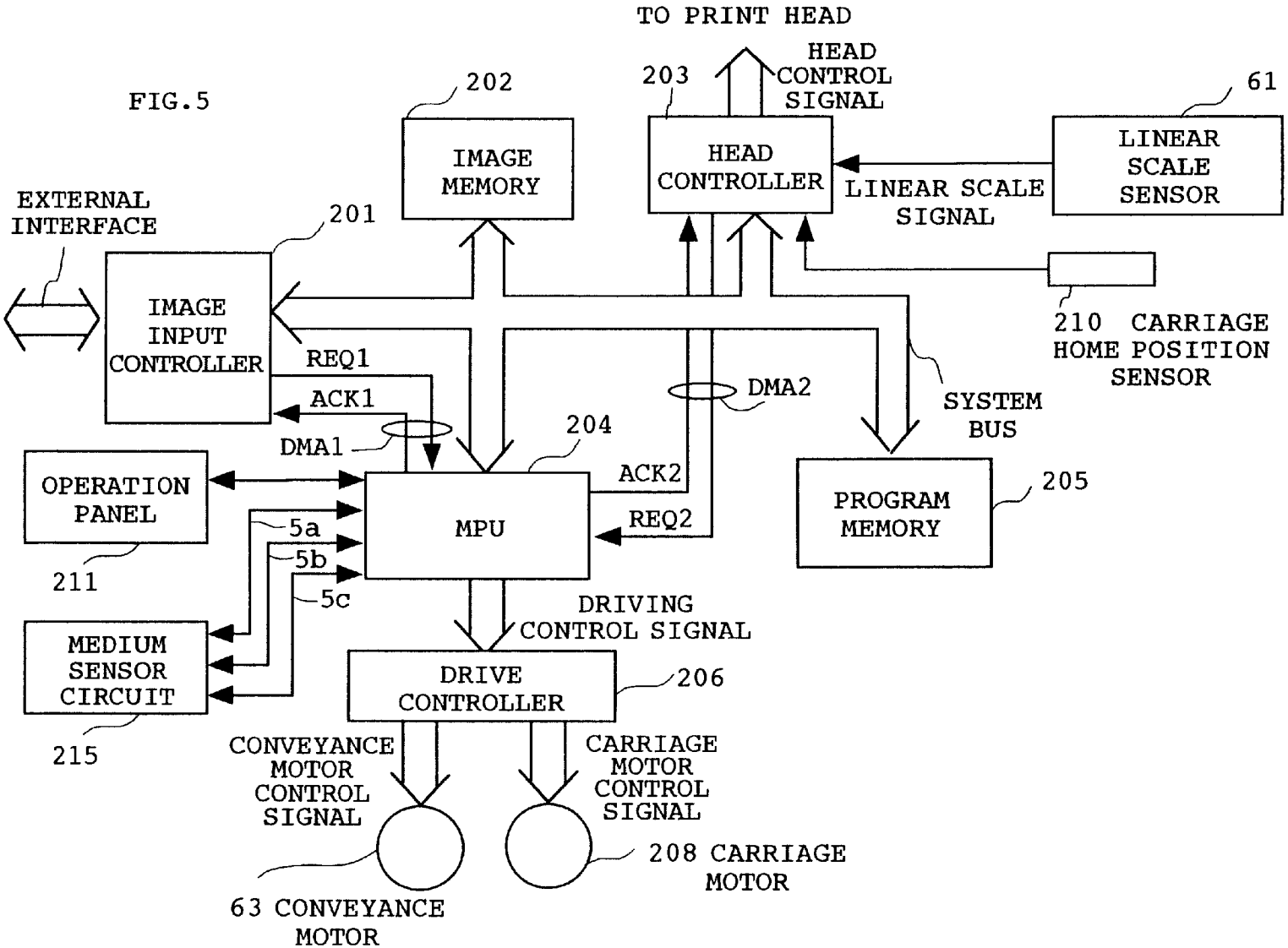
FIG. 5 is a control block diagram showing a printer in the embodiment.

FIG. 5 shows a control block diagram of a printer in this embodiment. Referring to FIG. 5, the operation that is executed from the time when image data is entered to the time when the image data is transferred to the print head 10 will be described.

An image input controller 201 accepts image data via an external interface. The image input controller 201 immediately outputs a DMA request (REQ1) to an MPU 204. In response to this request, the MPU 204 transfers the input image data to an image memory 202 in the DMA mode and, at the same time, returns a DMA acknowledge (ACK1) to the image input controller 201.

In addition, the MPU 204 transfers the image data to a head controller 203 to start printing. Upon receiving the image data, the head controller 203 transfers print data to the print head (10 in FIG. 1) based on the count value of the linear scale signal entered from the linear scale sensor 61 in synchronization with the movement of the carriage 12 and, at the same time, sends the print pulse to the head 10 to print data. When the image data in the head controller 203 is exhausted, the head controller 203 makes an image data request to the MPU 204 (DMA2). Note that a home position sensor 210 is located at a predetermined position within the plotter to define the reference position related to the movement of the carriage 12.

The MPU 204 drives, via a drive controller 206, the conveyance motor 63 that conveys the printing medium and a carriage motor 208 that reciprocates the carriage.

Numeral 215 indicates a medium sensor circuit that uses the medium detection unit 21 shown in FIG. 4. Its detailed circuit will be described later with reference to FIG. 6. Instructions from the user are issued, and messages to the user are displayed, via an operation panel 211.

The MPU 204 performs the control operation described above in accordance with the control program stored in a program memory 205.

Figure 6:
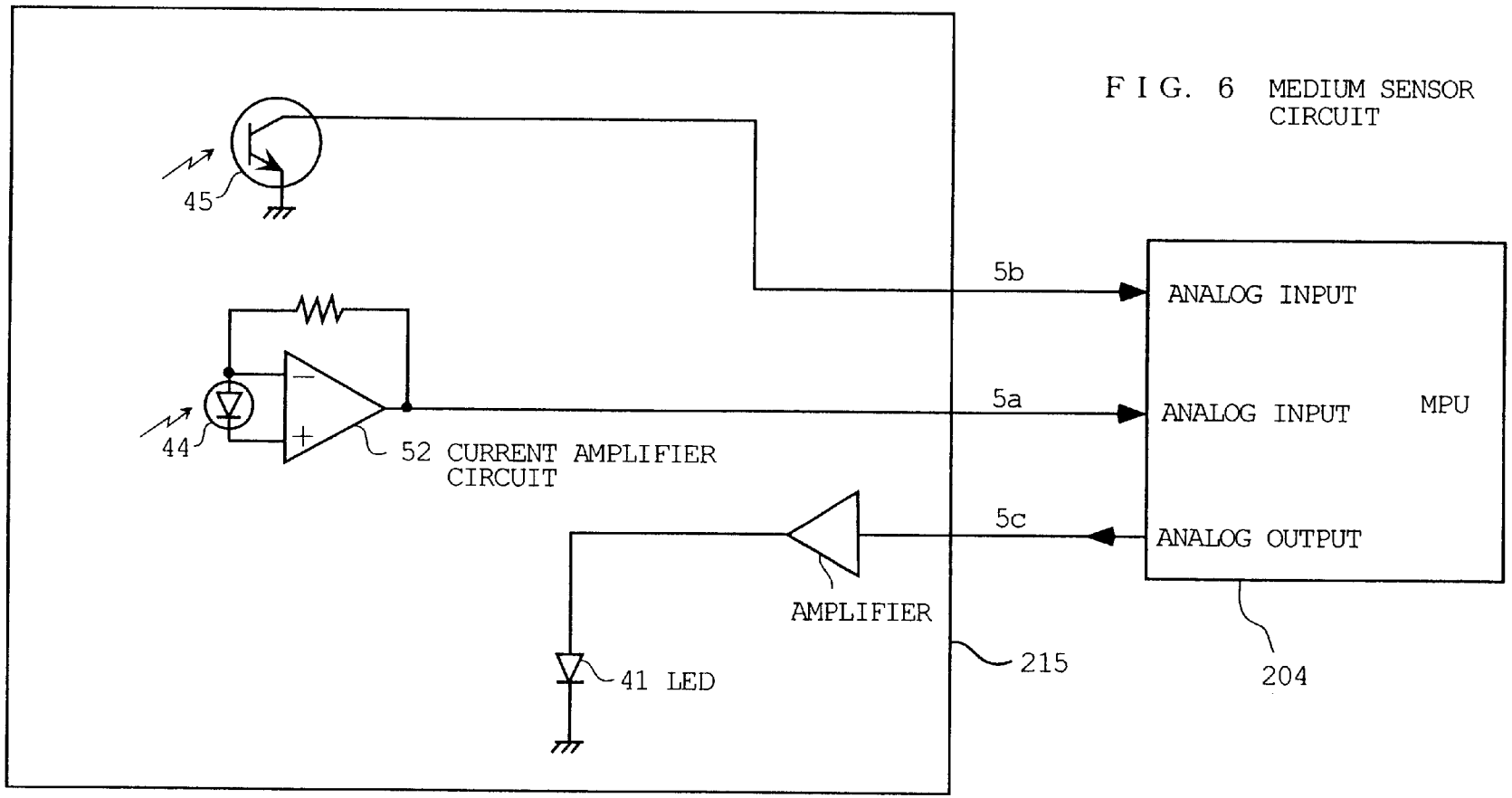
FIG. 6 is a circuit block diagram showing an example of the configuration of a medium sensor circuit 215 using a medium detection unit 21 shown in FIG. 4.

FIG. 6 shows an example of the configuration of the medium sensor circuit 215 using the medium detection unit 21 shown in FIG. 4.

The light emitting diode 41 can adjust the amount of light linearly using a signal 5*c* output from the MPU 204. The output current from the photodiode 44 is amplified by a current amplifier circuit 52 and is input to an analog port of the MPU 204 as a signal 5*a*. The output from the phototransistor 45 is input to another analog port of the MPU 204 as a signal 5*b*.

Figure 9:
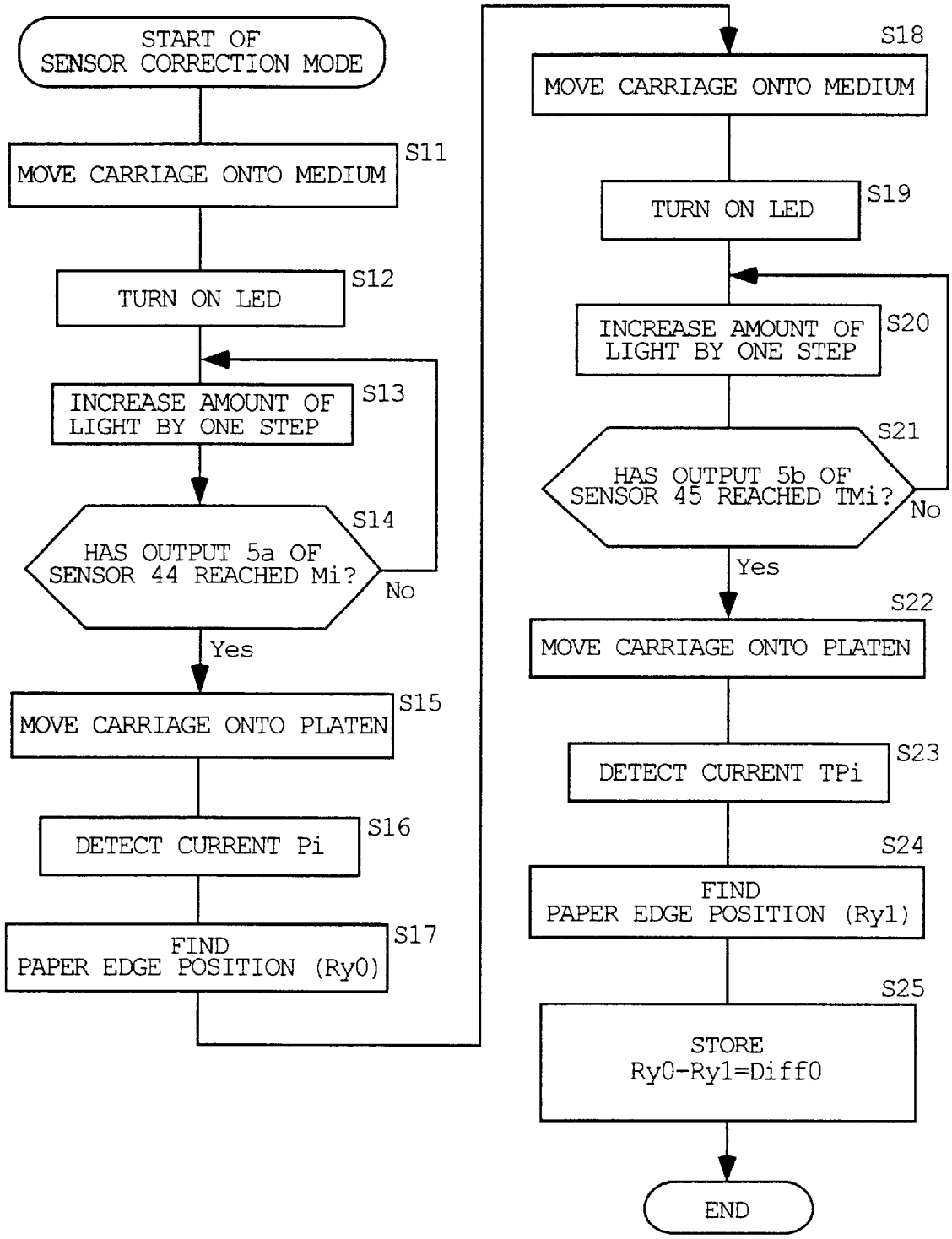
FIG. 9 is a flowchart showing a processing procedure for the sensor correction mode in the embodiment of the present invention.

Next, the read correction method of the phototransistor 45 will be described. First, a reference medium with a relatively low transmittance is set, and the sensor correction mode is executed. The reference medium, a printing medium for use in obtaining a correction value, may be a white plain paper. FIG. 9 shows the flowchart of the processing procedure for this sensor correction mode.

Figure 7:
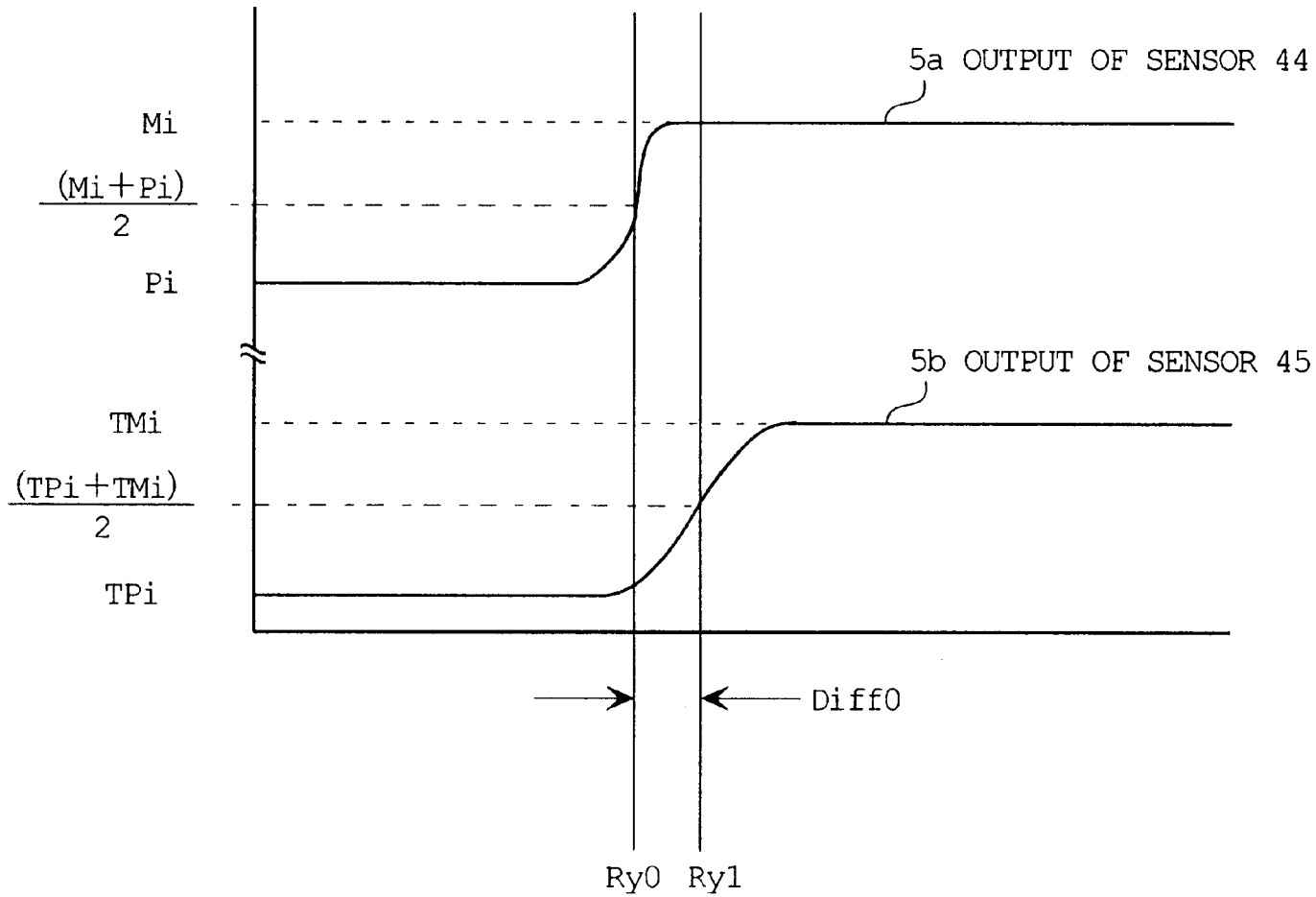
FIGS. 7(*a*) and 7(*b*) are waveform diagrams showing an example of output signals of the medium detection unit shown in FIG. 4.

When the sensor correction mode is started, the carriage is first moved onto the reference medium (S11) and the LED 41 is turned on (S12). The amount of light (lighting current, that is, LED driving level) of the LED 41 is increased, one step at a time, until the output signal 5*a* of the current amplifier circuit 52 connected to the photodiode 44 reaches a predetermined reference current Mi (S13, S14). Next, the carriage is moved onto the platen (S15), and the current Pi of the signal 5*a* on the platen is detected (S16). After that, the position Ry0 of the paper edge is obtained (S17). That is, with the threshold value as (Mi+Pi)/2, the carriage is scanned as shown in FIG. 7(*a*) while monitoring the signal 5*a* such that the carriage crosses the paper edge. At this time, the value of the linear scale 62 is obtained when the signal 5*a* crosses the threshold value. Based on this value, the position Ry0 of the paper edge is obtained.

Next, the carriage is moved onto the same reference medium (S18), and the LED is turned on (S19). The amount of light is increased, one step at a time, until the output signal 5*b* of the phototransistor 45 reaches a predetermined reference current TMi (S20, S21). The value of TMi may be equal to the value of Mi. After that, the carriage is moved onto the platen (S22), and the current TPi of the signal 5*b* on the platen is detected (S23). As shown in FIGS. 7(*a*) and (*b*), the difference between the two sensors in the waveform slopes of the signals that change at the paper edge indicates that there is a difference in the detection position. Thus, the paper edge position Ry1 is detected for the same paper edge (S24) More specifically, with the threshold value as (TMi+TPi)/2, the carriage is scanned as shown in FIG. 7(*b*) while monitoring the signal 5*b* such that the carriage crosses the paper edge. At this time, the value of the linear scale 62 is obtained when the signal 5*b* crosses the threshold value. Based on this value, the position Ry1 of the paper edge is obtained. Finally, the difference Diff0 between the paper edge positions Ry0 and Ry1 is stored in a memory (not shown) in a non-volatile manner (S25). The sensor correction value may be obtained in this way.

With respect to an object, such as a plain paper, which can be detected by the photodiode 44, the operator determines the amount of light of the LED 41 in the same sequence as that for detecting Ry0 described above in order to detect the width and the leading edge position of the medium.

Figure 10:
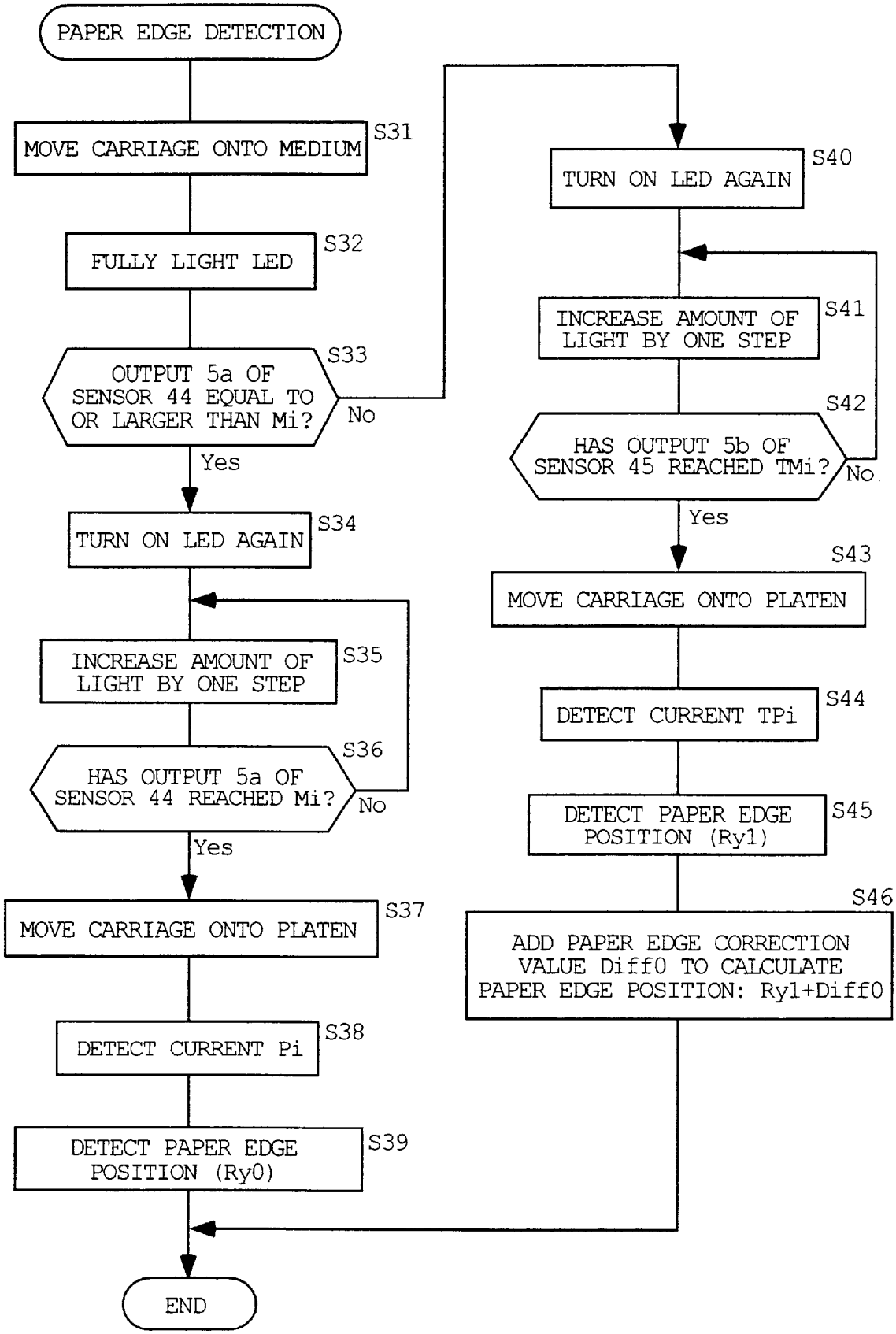
FIG. 10 is a flowchart showing a procedure for detecting a paper edge based on sensor correction values obtained by the processing in FIG. 9.

Next, with reference to the flowchart in FIG. 10, the processing procedure for detecting the paper edge based on a sensor correction value obtained in this way will be described. This procedure is particularly useful when an object, such as a clear film, which cannot be read by the sensor (photodiode) 44 is set.

First, the carriage is moved onto a medium to be detected (S31), and the LED is fully lighted (S32) Then, a check is made to see if the output signal 5*a* of the current amplifier circuit 52 based on the sensor 44 is equal to or larger than the reference current Mi (S33). If it is equal to or larger than Mi, the medium is determined to be a low-transmittance medium and a high-accuracy detecting sequence is executed for the position Ry0 using the sensor 44 described above. That is, the LED is turned on again (S34) and then the amount of light is increased such that the output signal 5*a* from the sensor 44 reaches the reference current Mi (S35, S36). Then, the carriage is moved onto the platen (S37) and the current Pi of the signal 5*a* on the platen is detected (S38). Then, the procedure described above is used to detect the position Ry0 of the paper edge (S39).

If the output signal 5*a* from the sensor 44 is smaller than the reference current Mi in step S33, the medium is determined to be a high-transmittance medium and a low-accuracy detecting sequence is executed for the position Ry1 using the sensor 45 described above. That is, the LED is turned on again (S40) and then the amount of light is increased such that the output signal 5*b* from the sensor 45 reaches the reference current TMi (S41, S42).

Then, the carriage is moved onto the platen (S43) and the current TPi is detected (S44). Then, the procedure described above is used to detect the position Ry1 of the paper edge. Adding the correction value Diff0 described above to the paper edge position Ry1 obtained as a result of processing above gives the corrected paper edge position, that is, a high-accuracy paper edge position Ry0 (S46).

The sensor correction mode shown in FIG. 9 may be executed either at factory shipment time or under instructions from the operator after shipment. In some cases, the printer may execute the sensor correction mode automatically after a plain paper is set.

Next, this detecting device capable of detecting the difference in the transparency of various types of media may be used, as an application of this detecting device, to determine the type of media, such as a plain paper, tracing paper (semi-transparent), clear film (transparent), and so on. This makes it easy to build a system that automatically finds a printing mode to be used. The principle will be described with reference to FIG. 8.

As shown in FIG. 8(*a*), the amount of the LED current Lia required for the output signal 5*a* from the photodiode 44 to reach Mi (LED driving level) on a medium depends largely on the type of the medium. The example shown in the figure indicates that the required amount increases in order of a plain paper, a tracing paper, and a clear film. Especially, in the case of a clear film, the signal does not reach Mi even if the LED is fully lighted. In contrast, as shown in FIG. 8(*b*), the amount of the LED current Lib required for the output signal 5*b* from the phototransistor 45 to reach Tmi does not depend largely on the type of the medium. As a result, the current difference Di between the LED current Lia and the LED current Lib depends largely on the type of the medium (Di1< Di2< Di3) as shows in FIG. 8(*c*). That is, Di2 that is the difference associated with a tracing paper is larger than Di1 that is the difference associated with a plain paper, and Di3 that is the difference associated with a clear film is much larger.

In this way, the type of medium may be determined based on the characteristics of the two sensors. In addition, the determination result may be used to automatically select a printing mode most suitable for a medium, for example, a standard (color standard) printing mode for a plain paper, a monochrome high-resolution printing mode for a tracing paper, and a color high-resolution printing mode (ink dry time considered) for a clear film.

Figure 11:
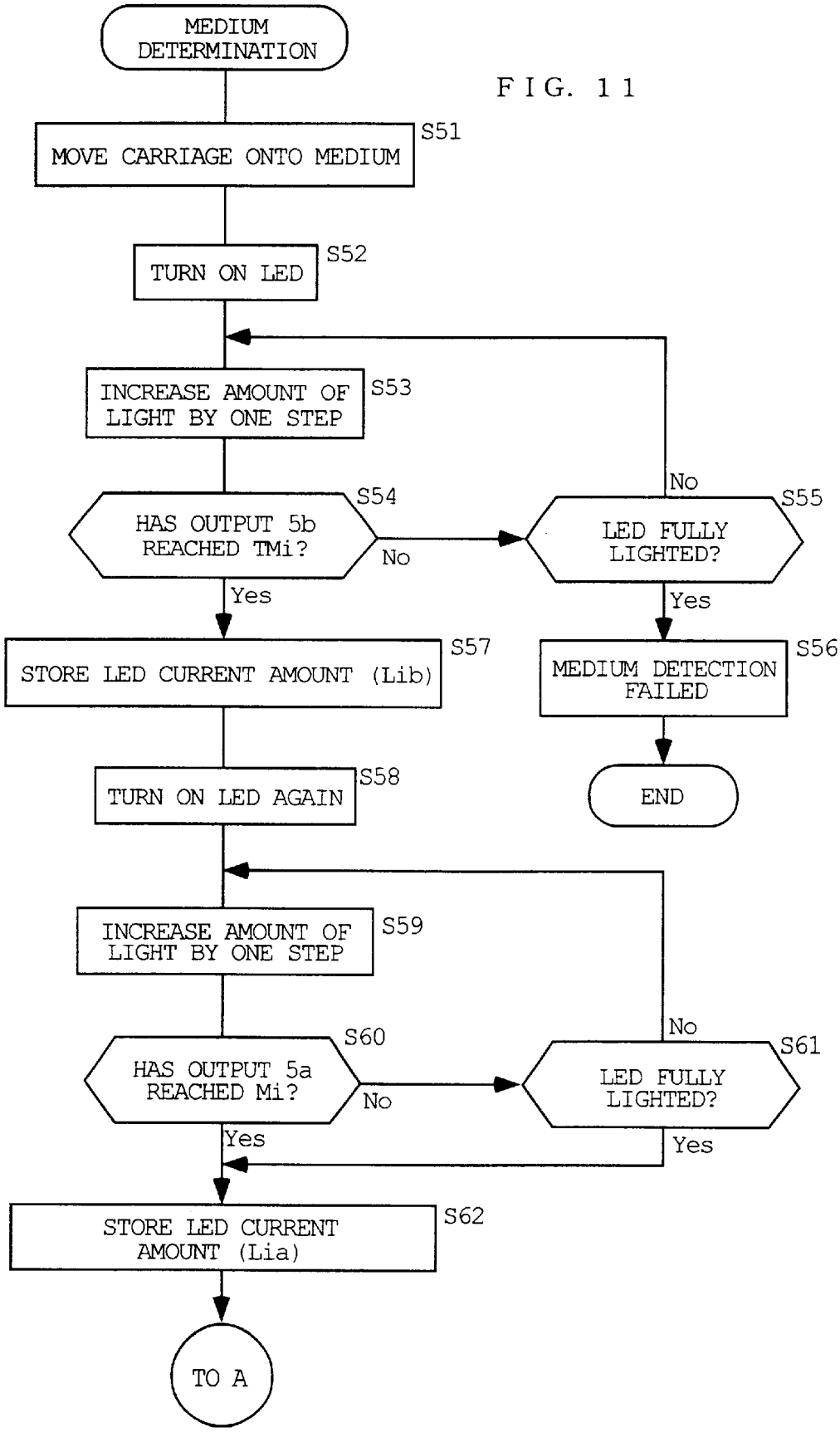
FIG. 11 is a flowchart showing medium determination processing that determines medium types.
Figure 12:
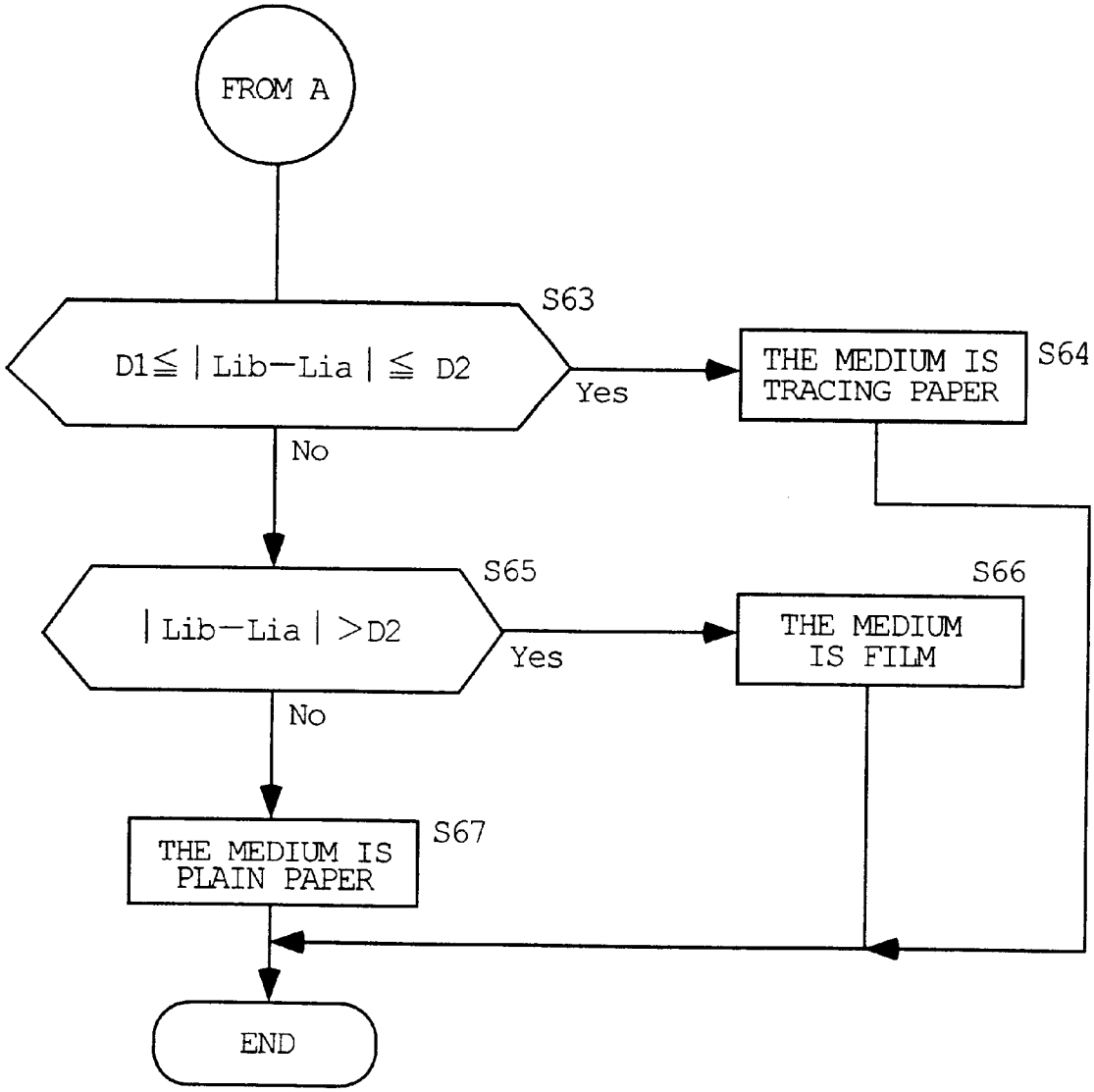
FIG. 12 is a flowchart showing medium determination processing that follows the processing in FIG. 11.

FIG. 11 and FIG. 12 show the flowcharts for medium determination processing in which the type of medium is determined.

First, the carriage is moved onto the medium (S51) and the LED is turned on (S52). Then, the amount of light is increased, one step at a time, until the output signal 5*b* of the phototransistor 45 reaches the reference amount of light TMi (S53, S54). If the LED is fully lighted during this period (S55, Yes), it is determined that medium detection has failed (S56).

After the signal has reached the reference amount of light TMi, the amount of LED current (Lib) at that time is stored. Then, the LED is turned on again (S58), and the amount of light is increased, one step at a time, until the output signal 5*a* from the photodiode 44 reaches the reference amount of light Mi (S59, S60). If the LED is fully lighted during this period (S61, Yes), control is passed to step S62.

In step S62, the amount of LED current (Lia) at this time is stored.

In FIG. 12, if the absolute value |Lib−Lia| of the difference between the amounts of two currents falls between the predetermined threshold values D1 and D2 (S63, Yes), then the medium is determined to be a tracing paper (S64). If the absolute value of the difference is larger than the threshold value D2 (S65, Yes), the medium is determined to be a film (S66). If none of those conditions is satisfied, the medium is determined to be a plain paper (S67). With the printing mode in the automatic setup mode, printing is done in a predetermined printing mode according to the type of medium that has been determined in this way.

While the preferred embodiments of the present invention have been described, various modifications and changes are possible. For example, some users may use mediums different from the above-mentioned reference mediums. In that case, the range of value Di (or threshold value) may be allocated to each medium and store the corresponding printing mode into the printer body to customize the correspondence between the LED driving level and the medium type (and the printing mode).

In addition, the sequential steps shown in the flowcharts need not be in the order described above.

INDUSTRIAL APPLICABILITY

The present invention provides means to implement a detecting device capable of reading from various types of media with high accuracy. The ability to detect a difference in the transmittance of media enables the type of medium to be identified and, in addition, the best-suited printing mode to be selected for each medium.

What is claimed is:

1. A medium detecting method for use in a printer wherein said method detects an edge position of a printing medium while scanning the printing medium, said method comprising the steps of:

scanning a relatively-low-transmittance reference medium with a first medium sensor and a second medium sensor each to detect an edge position of the reference medium, said first medium sensor being capable of detecting a relatively-low-transmittance printing medium with high accuracy, said second medium sensor being capable of detecting a high-transmittance medium with low accuracy;

calculating a difference between the edge positions as a correction value and storing the same; and if, when detecting any given printing medium, it is difficult for the first medium sensor to detect the printing medium, said second medium sensor is used to detect the medium to correct a resulting edge position with the correction value.

2. A medium detecting device for use in a printer wherein said device detects an edge position of a printing medium while scanning the printing medium, said device comprising:

a first medium sensor capable of detecting a relatively-low-transmittance printing medium with high accuracy;

a second medium sensor capable of detecting a high-transmittance medium with low accuracy;

means for scanning a relatively-low-transmittance reference medium with said first medium sensor and said second medium sensor each to detect an edge position of the reference medium;

means for calculating a difference between the detected edge positions;

means for storing the difference as a correction value in a non-volatile manner; and correction means for detecting the medium with said second medium sensor when it is difficult to detect the printing medium with said first medium sensor and for correcting a resulting edge position with the correction value.

3. The medium detecting device according to claim 2, further comprising a light source that emits light onto the printing medium obliquely; a first photo-sensor that detects diffused light of the printing medium from right above the printing medium and that acts as said first medium sensor, and [¶] a second photo-sensor that accepts a light from the light source reflected upward and obliquely on the printing medium and that acts as said second medium sensor.

4. The medium detection device according to claim 3, further comprising a medium detection unit which contains said light source, first photo-sensor, and second photo-sensor in one housing.

5. The medium detection device according to claim 3, further comprising medium determination means for calculating, for any given printing medium, a first driving level of said light source for outputting a predetermined sensor output amount of said first photo-sensor and a second driving level of said light source for outputting a predetermined sensor output amount of said second photo-sensor and, based on a difference between the two driving levels, for determining a type of the printing medium.

6. A printer that uses the medium detect on device according to claim 5, comprising a printing mode setting means for setting a print mode according to the type of the determined printing medium.

* * * * *